US012653312B2

(12) United States Patent
Yao et al.

(10) Patent No.: US 12,653,312 B2
(45) Date of Patent: Jun. 16, 2026

(54) SELF-LOCKING FOLDING BRACKET AND FOLDING CHAIR

(71) Applicant: Yongkang Mantuo Import & Export Co., Ltd, Jinhua (CN)

(72) Inventors: Fei Yao, Jinhua (CN); Meiju Ying, Jinhua (CN)

(73) Assignee: Yongkang Mantuo Import & Export Co., Ltd, Jinhua (CN)

( * ) Notice: Subject to any disclaimer, the term of this patent is extended or adjusted under 35 U.S.C. 154(b) by 207 days.

(21) Appl. No.: 18/432,978

(22) Filed: Feb. 5, 2024

(65) Prior Publication Data

US 2024/0172870 A1 May 30, 2024

Related U.S. Application Data

(63) Continuation of application No. PCT/CN2023/113738, filed on Aug. 18, 2023.

(30) Foreign Application Priority Data

Sep. 23, 2022 (CN) ..... 202222557159.6

(51) Int. Cl.
*A47C 4/28* (2006.01)

(52) U.S. Cl.
CPC ..... *A47C 4/286* (2013.01)

(58) Field of Classification Search
CPC ..... A47C 4/286; A47C 4/283; A47C 4/28
USPC ..... 297/16.2
See application file for complete search history.

(56) References Cited

U.S. PATENT DOCUMENTS

| | | | | |
|---|---|---|---|---|
| 6,302,479 | B1 * | 10/2001 | Zheng | A47C 4/286 297/16.2 |
| 7,959,232 | B2 * | 6/2011 | Sawada | B60N 2/686 297/440.16 |
| 9,622,583 | B1 * | 4/2017 | Lv | A47C 4/286 |
| D1,088,606 | S * | 8/2025 | Zhang | D6/387 |
| 2015/0359344 | A1 * | 12/2015 | Choi | A47C 4/286 248/313 |
| 2020/0323346 | A1 * | 10/2020 | Chen | A47C 4/286 |
| 2021/0368987 | A1 * | 12/2021 | Yang | A47C 4/38 |
| 2023/0092646 | A1 * | 3/2023 | Frankel | A47C 3/0255 297/16.2 |

(Continued)

FOREIGN PATENT DOCUMENTS

| | | | |
|---|---|---|---|
| CN | 204654314 U | | 9/2015 |
| CN | 108260976 A | | 7/2018 |
| CN | 217039425 U | * | 7/2022 |

*Primary Examiner* — Jose V Chen
(74) *Attorney, Agent, or Firm* — Westbridge IP LLC

(57) ABSTRACT

Disclosed are a self-locking folding bracket and a folding chair. The self-locking folding bracket includes two symmetrical foldable side supporting structures and a linkage assembly connected between the two side supporting structures, the linkage assembly includes two groups of side rods, two groups of cross rods and two groups of connecting rods, the cross rod and the connecting rod have an extreme position in the rotation process, the linkage assembly has a working state that passes down the extreme position so that the cross rod is abutted to the side rod, a folding state that the cross rod passes up the extreme position to leave the side rod, when the linkage assembly is in the working state, the linkage assembly is unfolded and able to maintain a distance between the two side supporting structures.

9 Claims, 6 Drawing Sheets

(56) References Cited

U.S. PATENT DOCUMENTS

| | | | | |
|---|---|---|---|---|
| 2024/0081534 | A1* | 3/2024 | Zhang | A47C 4/286 |
| 2024/0245218 | A1* | 7/2024 | Chen | A47C 4/286 |
| 2024/0374033 | A1* | 11/2024 | Chen | A47C 4/286 |
| 2025/0031853 | A1* | 1/2025 | Zhang | A47C 4/30 |
| 2025/0040714 | A1* | 2/2025 | Xia | A47C 3/02 |
| 2025/0134258 | A1* | 5/2025 | Yang | A47C 4/30 |
| 2025/0194803 | A1* | 6/2025 | Choi | A47C 4/286 |

* cited by examiner

SELF-LOCKING FOLDING BRACKET AND FOLDING CHAIR

CROSS-REFERENCE TO RELATED APPLICATIONS

This application is a continuation of International Application No. PCT/CN2023/113738, filed on Aug. 18, 2023, which claims priority to Chinese Patent Application No. 202222557159.6, filed on Sep. 23, 2022. All of the aforementioned applications are incorporated herein by reference in their entireties.

TECHNICAL FIELD

The application relates to the technical field of chairs, and in particular to a self-locking folding bracket and a folding chair.

BACKGROUND

Along with improvement of living standard, people have become interested in various outdoor camping or leisure sports, and more camping equipment has appeared on the market. In consideration of portability and flexibility in use, many camping equipment have a folding function, including folding chairs for satisfying seating and leaning requirements of users. An existing folding chair generally includes a cushion and a bracket structure, for example, a self-locking folding chair disclosed in Chinese patent CN216534552U, the bracket includes two mirror-symmetrical diagonal bracing mechanisms and a linkage mechanism connected between the two diagonal bracing mechanisms, and the gravity of a heavy object is transferred to the linkage mechanism of the bracket by utilizing the cushion and a pressing mechanism, so that the diagonal bracing mechanisms are unfolded and keep a stable unfolding state. However, in the structure which realizes self-locking by self-weight of a human body, the unfolding state of the diagonal bracing mechanism is not stable enough in the process of sitting on and getting off of the human body, the bracket is prone to folding, so that the folding chair topples over, and a user is easily unstable and even falls down; and in addition, the existing folding chair easily topples over in the folding process, which is inconvenient to store.

SUMMARY

In order to overcome the defects of the relevant art, the application provides a self-locking folding bracket and a folding chair.

In order to realize the purpose, the technical solution of the application is as follows.

A self-locking folding bracket includes two symmetrical foldable side supporting structures and a linkage assembly connected between the two side supporting structures.

The linkage assembly includes two groups of side rods, two groups of cross rods and two groups of connecting rods, the two groups of cross rods are disposed in an X-shaped crossed manner to form a first hinged point, one end of the cross rod is hinged with the lower end of the side supporting structure to form a second hinged point, the other end is hinged with the side rod through the connecting rod, the side rod is hinged with the upper end of the side supporting structure, the lower end of the side rod is hinged with the cross rod, and a third hinged point formed by the side rod and the cross rod is located between the first hinged point and the second hinged point.

The cross rod and the connecting rod have an extreme position in the rotation process, the linkage assembly has a working state that passes down the extreme position so that the cross rod is abutted to the side rod, and a folding state that the cross rod passes up the extreme position to leave the side rod, when the linkage assembly is in the working state, the linkage assembly is unfolded and able to maintain a distance between the two side supporting structures, and when the linkage assembly is in the folding state, the two side supporting structures are driven close to each other.

Preferably, the end part of the cross rod has an abutting end, which is matched with the side face of the side rod.

Preferably, the connecting rod includes a connecting portion and an extension portion connected at an included angle, the extension portion is hinged with the side rod, and the connecting portion is hinged with the cross rod.

Preferably, the connecting portion includes two first plates which are oppositely disposed and an abutting portion for connecting the two first plates, the end part of the cross rod is located between the two first plates and is rotatably connected with the first plates, and the abutting portion has an abutting face which is in abutting fit with the surface of the side rod.

The extension portion includes two second plates which are oppositely disposed, and the side rod is located between the two second plates and is rotatably connected with the second plates.

Preferably, the connecting rod and/or the cross rod are/is provided with a lifting handle for lifting.

Preferably, the side supporting structure includes a first connector located at the upper end, and two supporting rods symmetrically hinged with the first connector, the bottom of the supporting rod may be in contact with the ground, a stabilizing rod is hinged on the supporting rod, through the stabilizing rod, the supporting rod is limited to be unable to swing relative to the first connector, and the first connector is rotatably connected with the side rod.

The side supporting structure further includes a second connector located at the lower end, and the second connector is rotatably connected with the cross rod.

Preferably, one end of the stabilizing rod is hinged with the second connector, the other end is hinged with the middle of the supporting rod, and the bottom of the supporting rod is not higher than the lowest position of the second connector during the folding process of the side supporting structure.

Preferably, the second connector has a slot with an opening facing upward, and the bottom of the slot is a limiting plate limiting the rotation angle of the stabilizing rod.

And/or, the bottom of the supporting rod has a non-slip sleeve.

Preferably, the self-locking folding bracket further includes a vertical rod, which is disposed on the first connector, or, the vertical rod and the side rod are of an integrated structure.

The vertical rod has a mounting portion configured for mounting a lifting chair. In order to realize the purpose, the application further adopts the following technical solution.

A folding chair includes a lifting chair and the above self-locking folding bracket, and the lifting chair is detachably lifted on the self-locking folding bracket.

Compared with the relevant art, the application has the following beneficial effects.

For the self-locking folding bracket and the folding chair provided by the above technical solutions, unfolding and folding of the folding bracket are realized through unfolding and folding of the linkage assembly, meanwhile, the cross rod and the connecting rod have an extreme position in the rotation process, namely, two hinged points of the connecting rod are both on an extension line of the cross rod to realize collineation, while the cross rod continues to rotate downwards to cross the extreme position, so that the cross rod can only move downwards and cannot move upwards to be folded when the linkage assembly is stressed, meanwhile, since the cross rod abuts against the side rod and cannot move downwards under the action of the side rod, the linkage assembly may stably keep the unfolding state, therefore, the distance between the two side supporting structures is supported, and accidental folding of the folding bracket is avoided; while when the folding bracket needs to be folded, a force is applied to the cross rod to enable the cross rod to move upwards, leave the side rod and cross the extreme position, the two cross rods close each other, the linkage assembly is in a folding state, the two side supporting structures close each other, and thus the whole folding bracket is folded. The folding bracket of the application does not need an additional locking structure, and stable unfolding of the folding bracket is realized by utilizing the position of the linkage assembly and coordination of the cross rod, the connecting rod and side rod, the structure is simple, the operation is convenient, and topple over seldom occurs.

BRIEF DESCRIPTION OF THE DRAWINGS

In order to describe the specific implementation modes of the application or the technical solutions in the relevant art more clearly, the drawings required to be used in descriptions about the specific implementation modes or the relevant art will be simply introduced below, obviously, the drawings described below are only some implementation modes of the application, and other drawings can further be obtained by those of ordinary skill in the art according to the drawings without creative work.

DETAILED DESCRIPTION OF THE EMBODIMENTS

Figure 1:
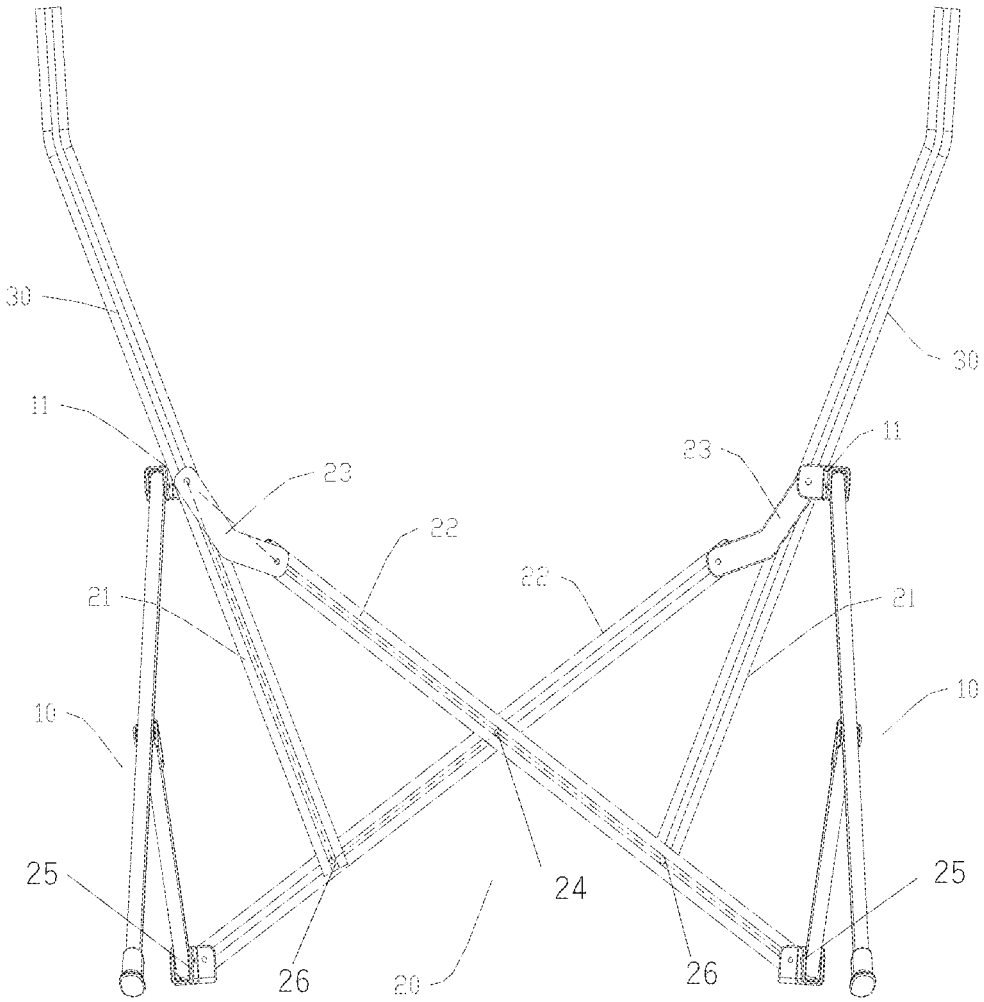
FIG. 1 is a schematic diagram when a linkage assembly is at an extreme position of an embodiment of the application.

The technical solutions of the application will be clearly and completely described below in combination with the drawings, and it is apparent that the described embodiments are not all but part of the embodiments of the application. All other embodiments obtained by those of ordinary skill in the art based on the embodiments of the application without creative efforts shall fall within the protection scope of the application.

In the description of the application, it is to be noted that orientation or position relationships indicated by terms "center", "upper", "lower", "left", "right", "vertical", "horizontal", "inner", "outer" and the like are orientation or position relationships shown in the drawings, are adopted not to indicate or imply that indicated devices or components must be in specific orientations or structured and operated in specific orientations but only to conveniently and simply describe the application and thus should not be understood as limits to the application. In addition, the terms "first", "second" and "third" are only adopted for description and should not be understood to indicate or imply relative importance.

In the description of the application, it is to be noted that unless otherwise definitely specified and limited, terms "install", "mutually connect", and "connect" should be broadly understood. For example, the terms may refer to fixed connection and may also refer to detachable connection or integration. The terms may refer to mechanical connection and may also refer to electrical connection. The terms may refer to direct mutual connection, may also refer to indirect connection through a medium and may refer to communication in two components. For those of ordinary skill in the art, specific meanings of these terms in the application can be understood according to a specific condition.

As shown in FIGS. 1-5, the embodiment of the application provides a self-locking folding bracket, which includes two symmetrical foldable side supporting structures 10 and a linkage assembly 20 connected between the two side supporting structures 10, the linkage assembly 20 includes two groups of side rods 21, two groups of cross rods 22 and two groups of connecting rods 23, the two groups of cross rods 22 are disposed in an X-shaped crossed manner to form a first hinged point 24, one end of the cross rod 22 is hinged with the lower end of the side supporting structure 10 to form a second hinged point 25, the other end is hinged with the side rod 21 through the connecting rod 23, the side rod 21 is hinged with the upper end of the side supporting structure 10, the lower end of the side rod 21 is hinged with the cross rod 22, and a third hinged point 26 formed by the side rod 21 and the cross rod 22 is located between the first hinged point 24 and the second hinged point 25.

Figure 2:
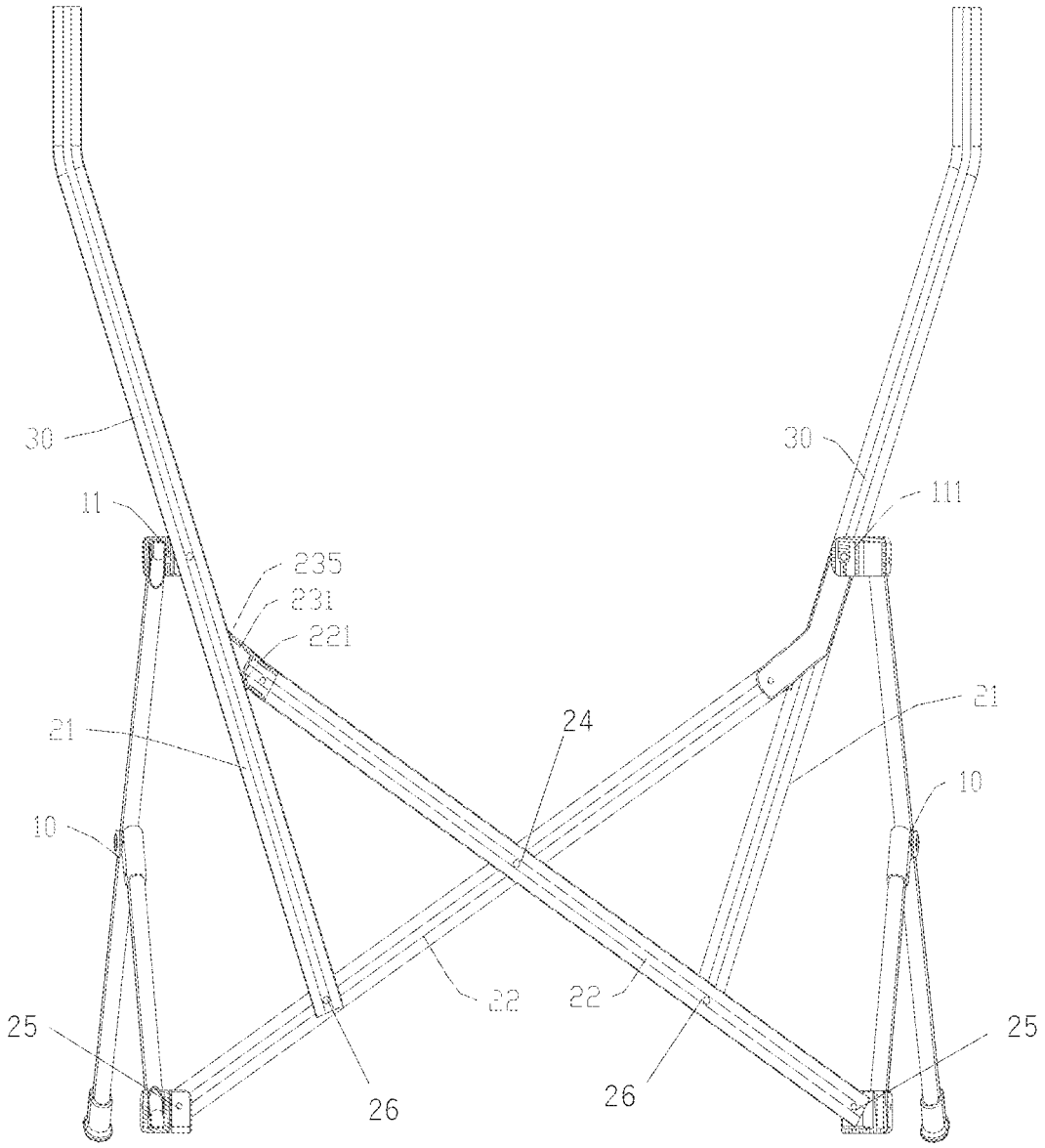
FIG. 2 is a schematic diagram when a linkage assembly is in a working state of an embodiment of the application.

Based on the above linkage assembly 20, the side rod 21 on one side, the connecting rod 23, the upper portion of one cross rod 22 and the lower portion of the other cross rod 22 form a four-bar linkage assembly, the four-bar linkage assembly has an extreme position in the rotation process, namely, as shown in FIG. 1, two hinged points of the connecting rod 23 are both on an extension line of the cross rod 22 to realize collineation, in such a case, the cross rod 22 is pressed downwards to enable the upper end part of the cross rod 22 to pass down the extreme position and abut against the side rod 21, as shown in FIG. 2, in such a case, the linkage assembly 20 is in a working state, when a heavy object or a user applies a pressure to the side supporting structure 10 and the side rod 21 in the folding bracket, the cross rod 22 can only move downwards, meanwhile, since the cross rod 22 abuts against the side rod 21 and cannot move downwards, self-locking of the linkage assembly 20 is realized, the stability that the linkage assembly 20 is in the working state is guaranteed, and thus the distance between the two side supporting structures 10 may be kept. While when the folding bracket needs to be folded, a force is applied to the cross rod 22 to enable it to move upwards, leave the side rod 21 and cross the extreme position, the two cross rods 22 close each other, the linkage assembly 20 is in a folding state, the two side supporting structures 10 close each other, and thus the whole folding bracket is folded.

As shown in FIG. 2, the end part of the cross rod 22 has an abutting end 221, and the abutting end 221 is matched with the side face of the side rod 21. Specifically, the tilt angle of the abutting end 221 is consistent with the tilt angle of the side rod 21 in the working state, thereby improving the stability of abutting between the cross rod 22 and the side face of the side rod 21, when the side face of the side rod 21 is a plane, the abutting end 221 is a plane; when the side face of the side rod 21 is a curved face, the abutting end 221 is a curved face, and the two curved faces fit each other to avoid torsion of the cross rod 22 relative to the side rod 21, thus improving the stability of abutting between the cross rod 22 and the side rod 21.

Preferably, the connecting rod 23 in the embodiment includes a connecting portion 231 and an extension portion 232 connected at an included angle, the extension portion 232 is hinged with the side rod 21, the connecting portion 231 is hinged with the cross rod 22, the extension portion 232 plays the role of prolonging the length of the cross rod 22 properly, so that the self-locking folding bracket has enough width when unfolded, the two side supporting structures 10 have a larger space, and the use experience of the user is more comfortable. The connecting portion 231 plays the role of connecting the end parts of the extension portion 232 and the cross rod 22. The connecting portion 231 and the extension portion 232 are connected at an included angle, when the linkage assembly 20 is in a working state, the acting force of side rod 21 on the connecting rod 23 is mainly in the direction of the extension portion 232, and the acting force on the connecting portion 231 is small, so as to avoid damaging the working state of linkage assembly 20.

Figure 3:
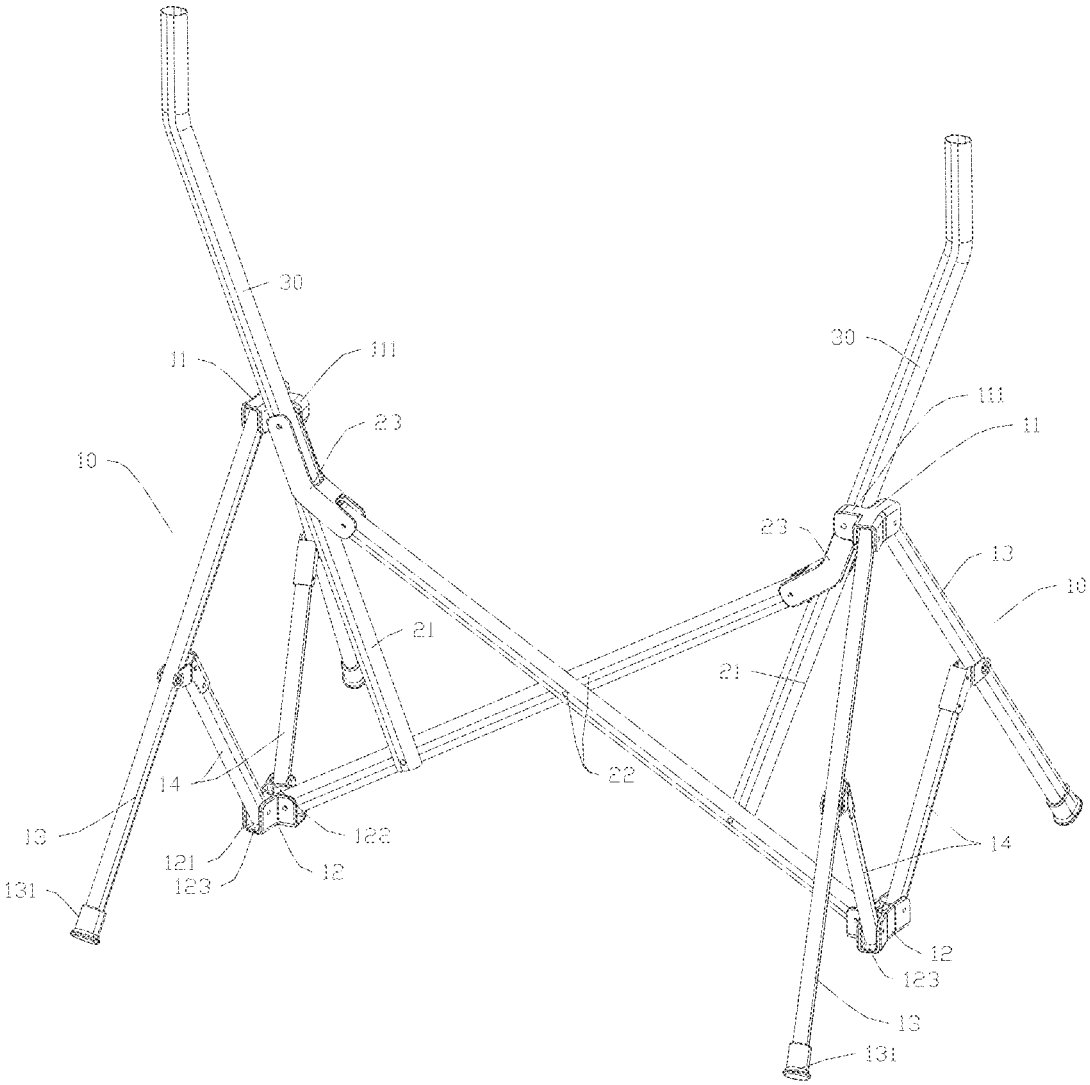
FIG. 3 is a schematic diagram of a self-locking folding bracket of an embodiment of the application, and the self-locking folding bracket in the figure is in an unfolding state.
Figure 4:
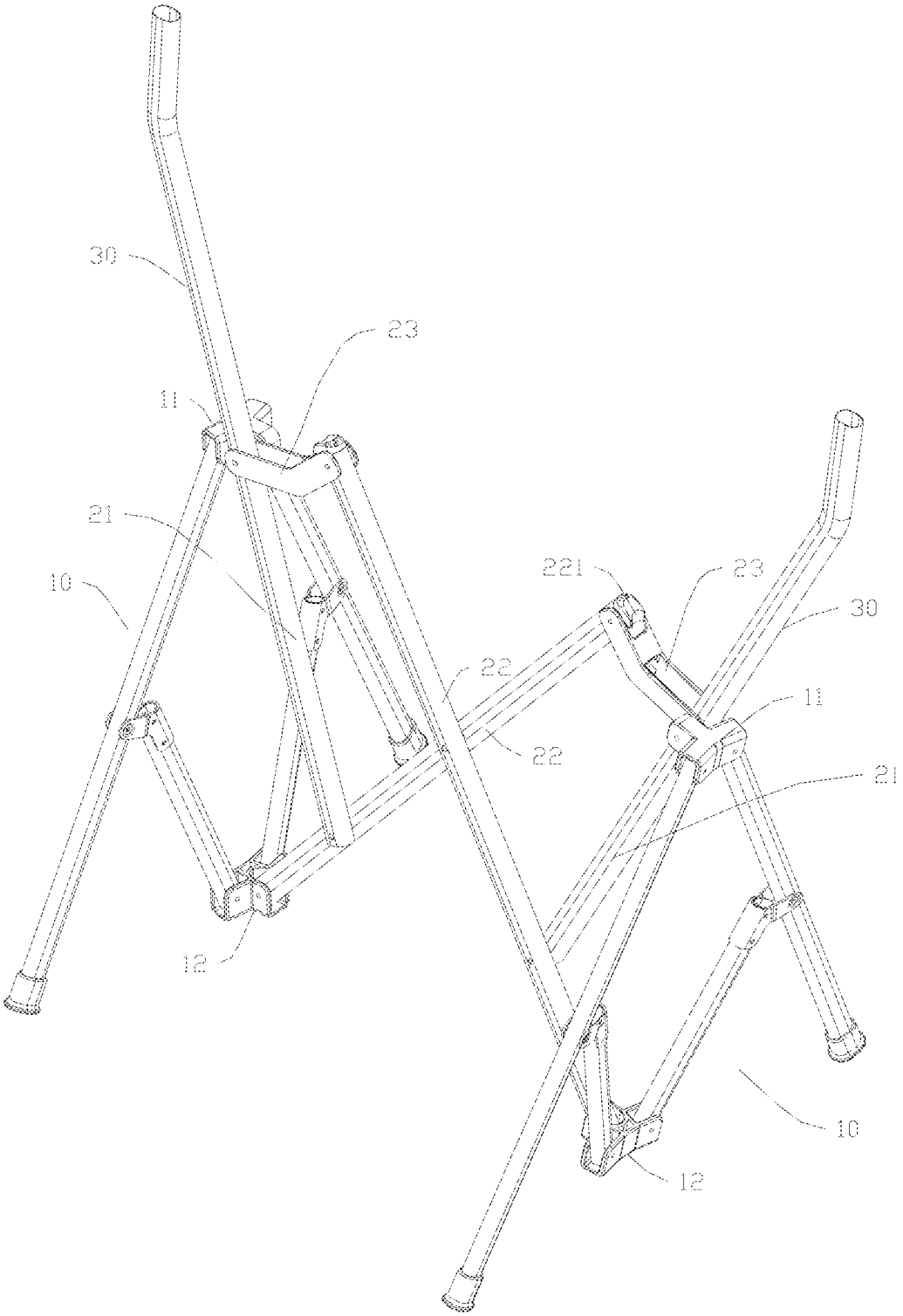
FIG. 4 is a schematic structure diagram of a self-locking folding bracket of an embodiment of the application, and the self-locking folding bracket in the figure is in a folding state.
Figure 5:
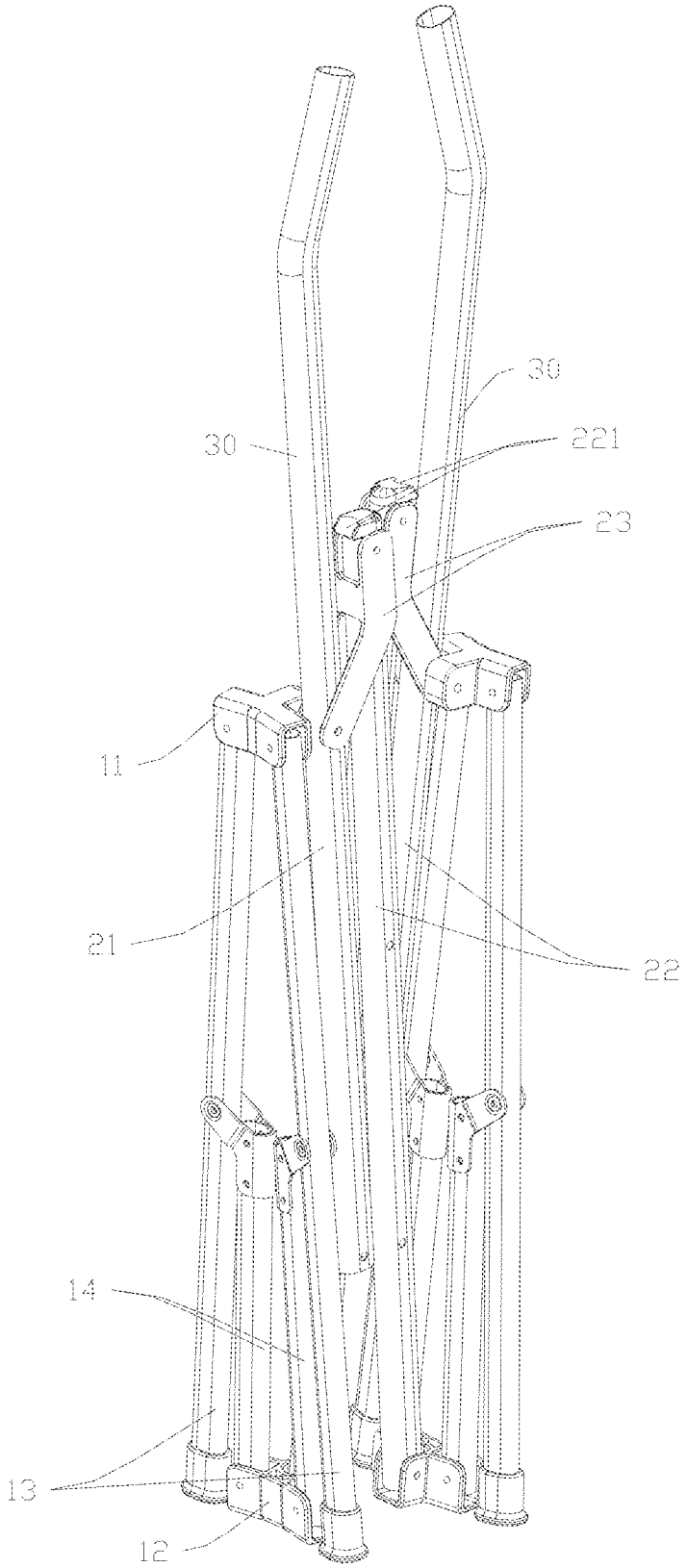
FIG. 5 is a schematic structure diagram of a self-locking folding bracket of an embodiment of the application, and the self-locking folding bracket in the figure is in a completely folding state.
Figure 6:
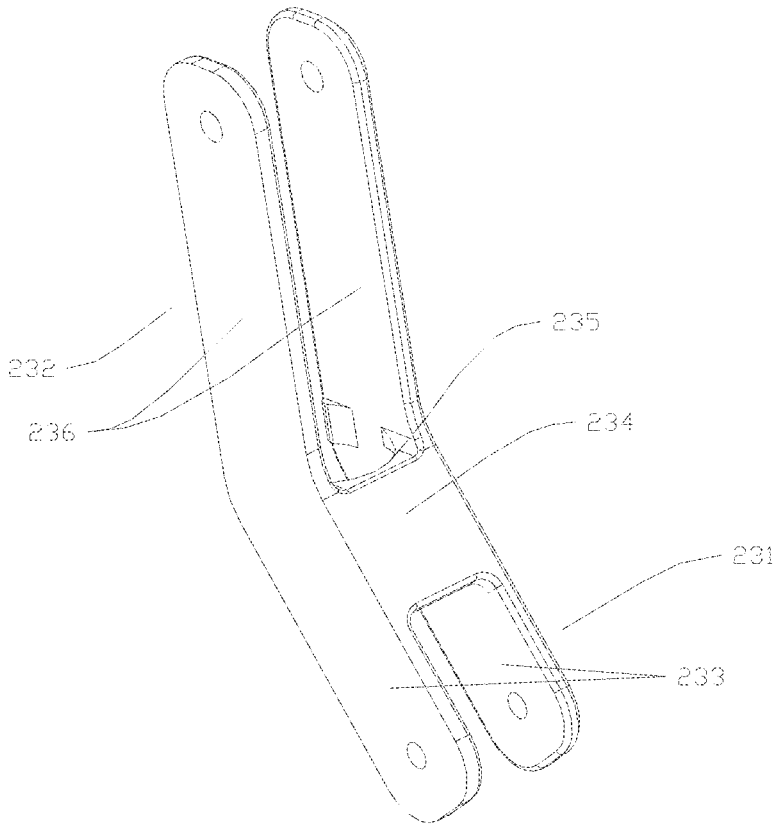
FIG. 6 is a schematic structure diagram of a connecting rod of an embodiment of the application.

Preferably, as shown in FIGS. 3 and 6, the connecting portion 231 includes two first plates 233 which are oppositely disposed and an abutting portion 234 for connecting the two first plates 233, the upper end part of the cross rod 22 is located between the two first plates 233 and is rotatably connected with the first plates 233, a gap for the end part of the cross rod 22 to move is formed between the two first plate 233, and in the folding process of the folding bracket, the end part of the cross rod 22 may pass out between the two first plates 233, as shown in FIGS. 4 and 5.

The abutting portion 234 has an abutting face 235 which is in abutting fit with the surface of the side rod 21, for guaranteeing that the connecting portion 231 and the side rod 21 are in a stable abutting state, thus improving stability of abutting between the cross rod 22 and the side rod 21. When the side face of the side rod 21 is a plane, the abutting end 221 is a plane; when the side face of the side rod 21 is a curved face, the abutting end 221 is a curved face, and the two curved faces fit each other to avoid torsion of the cross rod 22 relative to the side rod 21, thus improving the stability of abutting between the cross rod 22 and the side rod 21. In some embodiments, the side rod 21 is a round tube or oval tube, and the abutting face 235 is a matched curved face; and in other embodiments, the side rod 21 is a square tube, and the abutting face 235 is a plane.

The extension portion 232 includes two second plates 236 which are oppositely disposed, the side rod 21 is located between the two second plates 236 and is rotatably connected with the second plates 236, when the abutting portion 234 abuts against the side rod 21, the second plate 236 of the extension portion 232 attaches to and is parallel to the side rod 21, thus improving stability of the linkage assembly 20.

In order to facilitate folding of the linkage assembly 20, thus folding the folding bracket, the connecting rod 23 and/or the cross rod 22 are/is provided with a lifting handle for lifting (not shown in the figure). The lifting handle may be a single lifting handle corresponding to the connecting rod or cross rod on one side, or an integrated lifting handle connecting the connecting rods 23 or cross rods 22 on two sides. The lifting handle may be made of plastic or nylon When the folding bracket needs to be folded, the user may hold the lifting handle and apply an upward force to the connecting rod 23 or the cross rod 22, so that the cross rod 22 leaves the side rod 21 and passes up the extreme position to switch to the folding state.

As shown in FIGS. 3-5, the side supporting structure 10 includes a first connector 11, and two supporting rods 13 symmetrically hinged with the first connector 11, the bottom of the supporting rod 13 may be in contact with the ground, namely, four supporting rods 13 of the whole folding bracket are all in contact with the ground, at least four supporting points are available, which are beneficial for maintaining stability of the folding bracket, a stabilizing rod 14 is hinged on the supporting rod 13, through the stabilizing rod 14, the supporting rod 13 is limited to be unable to swing relative to the first connector 11, the side supporting structure 10 further includes a second connector 12, one end of the stabilizing rod 14 is hinged with the second connector 12, the other end is hinged with the middle of the supporting rod 13, the two supporting rods 13 may be unfolded or folded relative to each other, while the unfolding angle of the two supporting rods 13 is limited by the stabilizing rod 14, the second connector 12 has a slot 121 with an opening facing upward, and the bottom of the slot 121 is a limiting plate 123 limiting the rotation angle of the stabilizing rod 14.

Of course, in the embodiment, the limiting plate 123 may also not be disposed, and the unfolding angle of the stabilizing rod 14 and the supporting rod 13 is limited by the linkage assembly 20. In the embodiment, one end of the side rod 21 is hinged with the upper end of the side supporting structure 10 on one side, specifically, the side rod 21 is hinged with the first connector 11, as shown in FIG. 3, the first connector 11 has a boss 111, the side rod 21 is rotatably connected with the boss 111, the side rod 21 and the boss 111 may share a same rotating shaft with the side rod 21 and the connecting rod 23, or, rotation points of the side rod 21 and the boss 111 and rotation points of the side rod 21 and the connecting rod 23 are disposed respectively, so that they are not coaxial. The lower end part of the cross rod 22 is hinged with the lower end of the side supporting structure 10, specifically, the cross rod 22 is hinged with the second connector 12, as shown in FIG. 3, a rotating shaft groove 122 is disposed in the middle of the second connector 12, the end part of the cross rod 22 is located in the rotating shaft groove 122, and is rotatably connected with the second connector 12, and the rotating shaft groove 122 has an upward opening. When the linkage assembly is in a working state, the position of the cross rod 22 is also fixed, thus fixing the position of the second connector 12, as the two supporting rods 13 and two stabilizing rods 14 form a quadrilateral structure, the second connector 12, that is, the position of the connection point of the two stabilizing rods 14 is fixed, so that the quadrilateral structure is fixed, and the opening angle of the supporting rod 13 is also fixed, which ensures that the side supporting structure 10 is in a stable unfolding state. Also based on the above structure, when the linkage assembly 20 is unfolded, the supporting rod 13 of the side supporting structure 10 may also be automatically unfolded without additional operation, after the folding bracket is completely unfolded, the stabilizing rod 14 is connected with the middle of the supporting rod 13, meanwhile, it is guaranteed that the side supporting structure 10 is always in a completely unfolding state, thus guaranteeing stability of the folding bracket.

The reason why the existing folding chair is prone to topple over in the folding process is that, the hinged point of the stabilizing rod 14 and the supporting rod 13 is close to the bottom of the supporting rod 13, so that the height of the second connector 12 is smaller than the bottom height of the supporting rod 13 when the folding bracket is folded, and the bottom of the supporting rod 13 is off the ground, resulting in reduction of supporting points of the folding bracket in the folding process, so that topple easily occurs. In the embodiment, the stabilizing rod 14 is hinged with the middle of the supporting rod 13, and the length of the stabilizing rod 14 is controlled, so that the bottom of the supporting rod 13 is not higher than the lowest position of the second connector 12 during the folding process of the side supporting structure 10, that is, the bottom of the supporting rod 13 is always in contact with the ground, at least four supporting points of the folding bracket are available, topple over seldom occurs in the folding process, on the other hand, in the unfolding process and the use process, even self-locking of the linkage assembly fails, the four supporting rods are always in contact with the ground for supporting the folding bracket, the whole folding bracket seldom topples over to cause the user to fall over, thus better safety is realized. After folding, the bottom of the supporting rod 13 may be the same height as the lowest position of the second connector 12 or slightly lower than the lowest position of the second connector 12.

Preferably, the bottom of the supporting rod 13 has a non-slip sleeve 131, and the non-slip sleeve 131 is made of plastic.

As shown in FIG. 3, the self-locking folding bracket of the embodiment further includes a vertical rod 30, the vertical rod 30 has a mounting portion configured for mounting a lifting chair or other equipment, and the mounting portion may be a groove body such as a mounting groove and a clamping groove or a fixing part such as a convex block or a hook. In some embodiments, a vertical post may be fixedly disposed on the first connector 11, and is in a split structure with the side rod 21, or, in some other embodiments, the vertical rod 30 is of an integrated structure with the side rod 21 and is an extended part of the side rod 21, which is beneficial for transferring force of the heavy object or the human body to the cross rod 22, so that the structural strength of the vertical post and the bearing capacity of the folding bracket are improved. Of course, in some embodiments, an extension section extending towards ground is further disposed at the hinged position of the side rod 21 and the cross rod 22, and the bottom of the extension section may contact ground to transfer force of the heavy object or the human body to the ground.

Based thereon, the application further provides a folding chair, which includes a lifting chair, the lifting chair may be of a mesh structure or cloth surface formed by textile, or of a chair shape with fixed shape, the lifting chair is detachably lifted on the self-locking folding bracket, specifically, the lifting chair has a structure that may be matched with the mounting portion, such as a hanging rope or a clamping block. The folding chair is a swing chair, in use, the lifting chair is hung on the vertical rod 30 of the folding bracket, located between the two side supporting structures 10, through shaking of a connection point between the lifting chair and the bracket, a rider may swing back and forth as if using a swing. Of course, the connection point between the lifting chair and the bracket is also a fixed connection, and the folding chair is a common chair.

The implementation modes described above are only preferred implementation modes of the application and are not intended to limit the scope of protection of the application, and any insubstantial changes and substitutions made by those skilled in the art on the basis of the application shall fall within the scope of protection of the application.

What is claimed is:

1. A self-locking folding bracket, comprising two symmetrical foldable side supporting structures and a linkage assembly connected between the two side supporting structures;

wherein the linkage assembly comprises two groups of side rods, two groups of cross rods and two groups of connecting rods, and the two groups of cross rods are disposed in an X-shaped crossed manner to form a first hinged point; one end of the cross rod is hinged with a lower end of the side supporting structure to form a second hinged point, and an other end of the cross rod is hinged with the side rod through the connecting rod; the side rod is hinged with an upper end of the side supporting structure, a lower end of the side rod is hinged with the cross rod, the side rod and the cross rod form a third hinged point, and the third hinged point is located between the first hinged point and the second hinged point;

when two hinged points of the connecting rod are on an extension line of the cross rod to realize collineation, the cross rod and the connecting rod have an extreme position in a rotation process, the linkage assembly is in a working state when the cross rod passes down the extreme position and the cross rod is abutted to the side rod, and the linkage assembly is in a folding state when the cross rod moves upward past the extreme position and away from the side rod; and when the linkage assembly is in the working state, the linkage assembly is unfolded and maintains a distance between the two side supporting structures, and when the linkage assembly is in the folding state, the linkage assembly causes the two side supporting structures to be close to each other.

2. The self-locking folding bracket according to claim 1, wherein an end part of the cross rod has an abutting end, and the abutting end is cooperated with a side face of the side rod.

3. The self-locking folding bracket according to claim 1, wherein the connecting rod comprises a connecting portion and an extension portion connected at an included angle, the extension portion is hinged with the side rod, and the connecting portion is hinged with the cross rod.

4. The self-locking folding bracket according to claim 3, wherein the connecting portion comprises two first plates, the two first plates are oppositely disposed, and an abutting portion for connecting the two first plates, an end part of the cross rod is located between the two first plates and is rotatably connected with the first plates, the abutting portion has an abutting face, and the abutting face is in abutting fit with a surface of the side rod;

the extension portion comprises two second plates, and the two second plates are oppositely disposed, and the side rod is located between the two second plates and is rotatably connected with the second plates.

5. The self-locking folding bracket according to claim 1, wherein the side supporting structure comprises a first connector located at the upper end, and two supporting rods symmetrically hinged with the first connector, a bottom of the supporting rod is in contact with ground, a stabilizing rod is hinged on the supporting rod, through the stabilizing rod, the supporting rod is limited to be unable to swing relative to the first connector, and the first connector is rotatably connected with the side rod;

the side supporting structure further comprises a second connector located at the lower end, and the second connector is rotatably connected with the cross rod.

6. The self-locking folding bracket according to claim 5, wherein one end of the stabilizing rod is hinged with the second connector, the other end is hinged with a middle of the supporting rod, and the bottom of the supporting rod is not higher than a lowest position of the second connector during a folding process of the side supporting structure.

7. The self-locking folding bracket according to claim 6, wherein the second connector has a slot with an opening facing upward, and a bottom of the slot is a limiting plate limiting a rotation angle of the stabilizing rod; and/or the bottom of the supporting rod has a non-slip sleeve.

8. The self-locking folding bracket according to claim 5, further comprising a vertical rod, wherein the vertical rod is disposed on the first connector; and the vertical rod has a mounting portion configured for mounting a lifting chair.

9. The self-locking folding bracket according to claim 5, further comprising a vertical rod, wherein the vertical rod and the side rod are of an integrated structure; and the vertical rod has a mounting portion configured for mounting a lifting chair.

* * * * *